United States Patent [19]

Kiuchi

[11] Patent Number: 4,648,562

[45] Date of Patent: Mar. 10, 1987

[54] MAGNETIC TAPE WINDING APPARATUS

[75] Inventor: Seiji Kiuchi, Kanagawa, Japan

[73] Assignee: Fuji Photo Film Co., Ltd., Kanagawa, Japan

[21] Appl. No.: 736,586

[22] Filed: May 21, 1985

[30] Foreign Application Priority Data

May 21, 1984 [JP] Japan ..... 59-100396

[51] Int. Cl.[4] ..... B65H 19/26

[52] U.S. Cl. ..... 242/56 A

[58] Field of Search ..... 242/56 A, 56 R, 64

[56] References Cited

U.S. PATENT DOCUMENTS 4,540,132 9/1985 Kubo ..... 242/56 A X

FOREIGN PATENT DOCUMENTS 2724219 12/1977 Fed. Rep. of Germany ... 242/56 A

*Primary Examiner*—John M. Jillions

*Attorney, Agent, or Firm*—Sughrue, Mion, Zinn, Macpeak, and Seas

[57] ABSTRACT

A magnetic tape winding apparatus including a magnetic tape winding unit and an arranging unit wherein a group of operations of connecting, winding and cutting a magnetic tape supplied from a magnetic tape supplying source (roll stock) and a group of operations of cutting a leader tape fastened to a pair of reels and connecting the leader tape of each reel to the magnetic tape are carried out in a parallel mode to greatly decrease the time required for completing winding operations.

9 Claims, 13 Drawing Figures

MAGNETIC TAPE WINDING APPARATUS

BACKGROUND OF THE INVENTION

The present invention relates to an apparatus for winding a magnetic tape, such as a video tape or audio tape, on a pair of reels. More particularly, the invention relates to an apparatus for automatically winding a magnetic tape on a larger number of pairs of reels, such as in the manufacture of tape cassettes.

The magnetic tape of a video or audio magnetic tape cassette has leader tapes at both ends. In the manufacturing process thereof, magnetic tape and leader tapes are wound on one of the pair of reels. The magnetic tape winding operation was originally carried out manually, but of course manual winding is unsuitable for large-volume production. Accordingly, a variety of atuomatic tape winding apparatuses with which a magnetic tape can be automatically wound on reels have been proposed. (See, for instance, Japanese Laid-Open Patent Applications Nos. 105464/1983, 105465/1983 and 105466/1983.)

In these automatic winding apparatuses, a pair of reels to which a leader tape has been fastened is supplied, and the tape is cut into two parts. The leader tape of one of the reels and a magnetic tape from a magnetic tape roll stock are joined together with splicing tape, and a predetermined length of the magnetic tape is wound on the reel. Thereafter, the magnetic tape is cut, and the free end of the magnetic tape connected to the leader tape fastened to the other reel with splicing tape. These operations are automatically carried out.

In these apparatuses, an automatic reel supplying device and an automatic reel removing device have been improved in various manners in order to decrease the time required for winding the magnetic tape on the pair of reels.

As is apparent from the above description, in the conventional automatic winding apparatuses, the operations of cutting the leader tape and connecting the magnetic tape to the leader tapes fastened to the reels are carried out at a cutting and joining section. Accordingly, for the period of time which elapses from the time of cutting the leader tape fastened to the pair of reels until the time of winding the predetermined length of the magnetic tape on one of the reels, the other reel must be kept in a stand-by state. It is essentially impossible for the conventional automatic winding system to eliminate the time loss due to stand-by and to reduce the time required for winding.

SUMMARY OF THE INVENTION

Accordingly, an object of the invention is to eliminate the above-described difficulty accompanying a conventional magnetic tape winding apparatus.

More specifically, an object of the invention is to provide a magnetic tape winding apparatus in which neither of the pair of reels on which a magnetic tape is to be wound are held stationary, whereby the time required for winding the magnetic tape is greatly decreased.

The foregoing object and other objects of the invention have been achieved by the provision of a magnetic tape winding apparatus which comprises: a turntable, and first and second winding shafts and first and second movable tape receiving stands being mounted on said turntable with the first winding shaft and first movable tape receiving stand being arranged symmetrically on opposite ends of said turntable with respect to the second winding shaft and second movable tape receiving stand, the turntable being rotatably mounted so that positions of the first and second winding shafts and the first and second movable tape receiving stands can be exchanged for each other by turning the turntable through 180°; reel moving means having a reel mounting shaft, and means for moving the reel mounting shaft along a predetermined path, the stationary tape receiving stand being located adjacent a one of the first and second movable tape receiving stands as determined by a rotary position of the turntable, the reel moving means, a stationary tape receiving stand, and the one of the first and second movable tape receiving stands and its associated one of the first and second winding shafts constituting arranging means; a stationary tape receiving stand located adjacent the other of the first and second winding shafts and movable tape receiving stands, each tape receiving stand having means for holding a tape on a surface thereof, the other of the stationary tape receiving stand and the other of the first and second winding shafts and movable tape receiving stands constituting magnetic tape winding means; and tape cutting means and tape joining means provided for each of the arranging means and the magnetic tape winding means.

In the arranging means, a pair of reels to which a leader tape has been fastened are mounted on the winding shaft and the reel mounting shaft of the arranging means. The reel on the side of the reel moving means is moved to a tape cutting and joining section formed by the movable tape receiving stand and the stationary tape receiving stand. The leader tape on the movable and stationary tape receiving stands is held while the tape is cut. The turntable is then rotated to deliver the reel on the side of the turntable to the magnetic tape winding means with the cut leader tape held on the movable tape receiving stand. At the tape cutting and joining section, the magnetic tape wound on the reel which is delivered thereto when the turntable is rotated is connected to the leader tape of the reel remaining at the reel moving means. In the magnetic tape winding means, the leader tape of the reel delivered from the arranging means is connected to an end of a magnetic tape supplied from a magnetic tape supplying source at a tape cutting and joining section formed by the movable tape receiving stand and the stationary tape receiving stand of the winding means. A predetermined length of the magnetic tape is then wound on the reel, and the magnetic tape is cut at the tape cutting and joining section. Finally, the reel on which the magnetic tape has been wound is delivered to the arranging means.

The nature, principle and utility of the invention will become more apparent from the following detailed description when read in conjunction with the accompanying drawings.

DESCRIPTION OF THE OREFERRED EMBODIMENTS

A preferred embodiment of the invention will be described with reference to the accompanying drawings.

Figure 2:
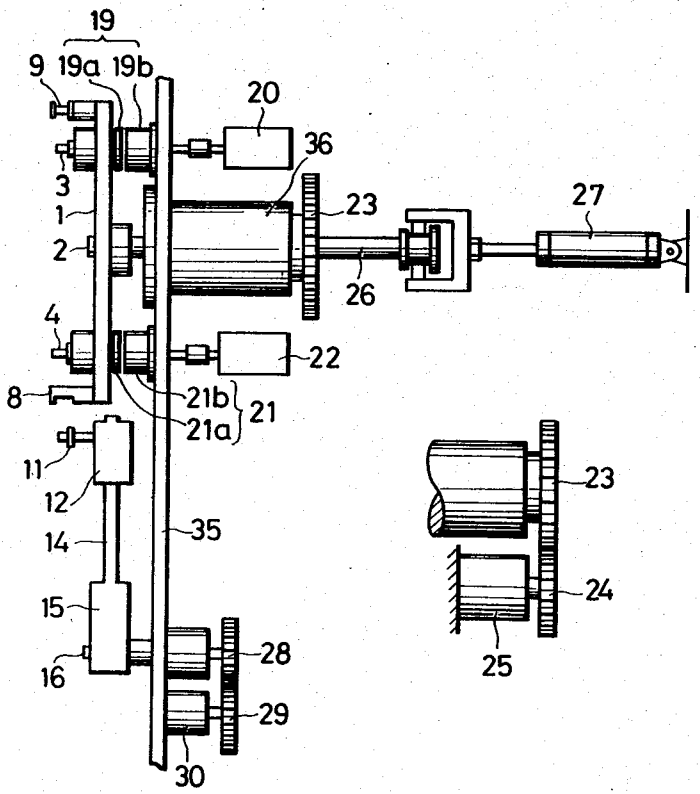
FIGS. 1 and 2 are a front view and a side view, respectively, showing essential components of an example of a magnetic tape winding apparatus according to the invention.
Figure 1:
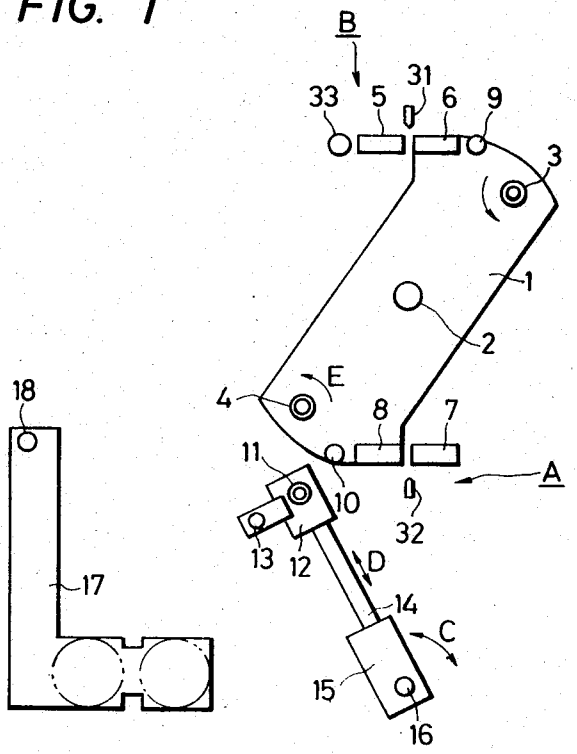

FIG. 1 is a front view showing an example of a magnetic tape winding apparatus according to the invention, and FIG. 2 is a side view of the apparatus.

As shown in these figures, a first winding shaft 3 and movable tape receiving stand 6, and a second winding shaft 4 and movable tape receiving stand 8 are provided symmetrically on opposite ends of a turntable 1, which is rotatably arranged on a central shaft 2. Reels can be detachably mounted on the winding shafts 3 and 4. the winding shafts and the movable tape receiving stand can be interchanged, as described below in more detail, by rotating the turntable 1 through 180°.

The winding shaft 4 and the movable tape receiving stand 8 on one side together with a stationary tape receiving stand 7 and reel moving device (described below) form an arranging unit A, and they together with the other winding shaft, the other movable tape receiving stand, and a stationary tape receiving stand (reference numerals 3, 6 and 5 in FIGS. 1 and 2) form a magnetic tape winding unit B.

Guide rollers 9 and 10 are disposed near the movable tape receiving stands 6 and 8, respectively. The surfaces of the movable tape receiving stands 6 and 8 are flush with those of the stationary tape receiving stands 5 and 7, respectively. Small gaps are provided between the stands 5 and 6 and between the stands 7 and 8.

Small holes for applying suction to and retaining tapes at each tape receiving stand are communicated with a vacuum pump or the like (not shown). A magnetic tape or leader tape can be retained on the surface of the tape receiving stand thereby. The arranging unit A and the magnetic tape winding unit B are provided with cutters 32 and 31 for cutting tapes, splicing devices (not shown) for splicing tapes with a splicing tape, and splicing tape supplying units (not shown), respectively.

The arranging unit A has a reel moving mechanism composed of a swinging block 15 which is swingable about a pin (fulcrum) 16 in the directions of a double-headed arrow C, and a sliding block 12 which is slidable in the directions of a double-headed arrow D with respect to the swinging block 15. The sliding block 12 has a shaft 11 on which a reel is detachably mounted, and a guide roller 13.

In the reel moving unit, the reel mounting shaft 11 is confronted with the winding shaft (the shaft 4 in the case of FIG. 1) on the turntable. When a pair of reels on which a leader tape has been wound are mounted on the shafts 4 and 11 by a reel supplying mechanism having a swinging lever 17 swingable about a swinging shaft 18, the sliding block 12 is slid on the sliding shaft 14 in such a manner that it is retracted toward the block 15 (the driving mechanism therefor being not shown). Then, the swinging bock 15 is swung clockwise (in FIG. 1) about the swinging shaft 16 through gears 28 and 29 by a rotary actuator 30 disposed on the rear side of a base plate 35, following which the sliding block 12 is moved along the sliding shaft 14 in the direction away from the block 15 so that the leader tape wound on the reels is placed on the tape receiving stands 7 and 8, and retained thereon by suction. These moving mechanisms and a moving mechanism in a reel moving unit (described later) will be referred to as mechanisms for moving reels along predetermined loci in the following description.

As shown in FIG. 2, motors 20 and 22 are provided on the base plate 35 to drive the winding shafts 3 and 4 on the turntable 1. The shafts 3 and 4 are coupled to the motors 20 and 22 through clutches 19 and 21, respectively. In the clutches 19 and 21, friction plates 19*a* and 21*a* fixed to the winding shafts 3 and 4, respectively, are selectively engageable by and disengageable from coils 19*b* and 21*b*, respectively. Accordingly, when it is required to turn the turntable 1 through 180° (as described later), the shafts 3 and 4 are disengaged from the motors 20 and 22, respectively, by deenergizing the coils 19*b* and 21*b*. After the turntable 1 has been turned through 180°, the shafts 3 and 4 are engaged with the motors 22 and 20, respectively, by energizing the coils 19*b* and 21*b*.

In the arranging unit A, a pair of reels are mounted on the shafts 4 and 11, as described above. The winding shaft (reference numeral 4 in the case of FIG. 1) is rotated in the direction of the arrow E by the motor 22 so that, when the reel is moved away from or towards the winding shaft 4 by the reel moving unit (the reel being moved towards the shaft 4 after the leader tape is connected to the magnetic tape as described below), the leader tape (or magnetic tape) is held under suitable tension.

In the feel supplying unit, the swinging lever 17 has a reel holding mechanism (not shown) adapted to hold a pair of reels (indicated by two-dot/chain lines) to which leader tapes have been connected, as described above. The swinging lever 17 is swung about the swinging shaft 18 to mount the pair of reels on the winding shaft (the shaft 4 in the case of FIG. 1) and the shaft 11. In the arranging unit, the end of a magnetic tape wound on one reel is connected to the remaining leader tape connected to another reel to provide a pair of reels. The reels are mounted on the winding shaft 4 and the shaft 11 positioned as shown in FIG. 1. The reels thus mounted can be removed by holding and swinging them with the reel supplying unit.

The turntable 1 is rotatably mounted on the base plate 35 through a shaft 2 and a bearing 36. A shaft 26 on the rear side of the turntable is reciprocated by an air cylinder 27 and the same rotated by a gear 23 perpendicularly to the base plate 35 (the shaft 26 being a splined or ball-splined shaft, for instance).

The turntable 1 is turned as follows: First, the turntable 1 is moved in a direction perpendicular to the base plate 35 (to the left in FIG. 2) by the shaft 26 as the latter is driven by an air cylinder 27. Then, the turntable 1 is turned through 180° by a rotary actuator 25 with the aid of the gear 23 and a gear 24. Under this condition, the turntable 1 is moved towards the base plate 35 (to the right in FIG. 2) by the air cylinder so that it is set in place. With the tape winding apparatus of the invention constructed as described above, the turntable 1 can be turned without striking the stationary reel receiving stands 5 and 7 and other peripheral members.

The operations of the magnetic tape winding unit and the arranging unit will be described with reference to FIGS. 3 through 13, which show magnetic tape winding steps.

Figure 3:
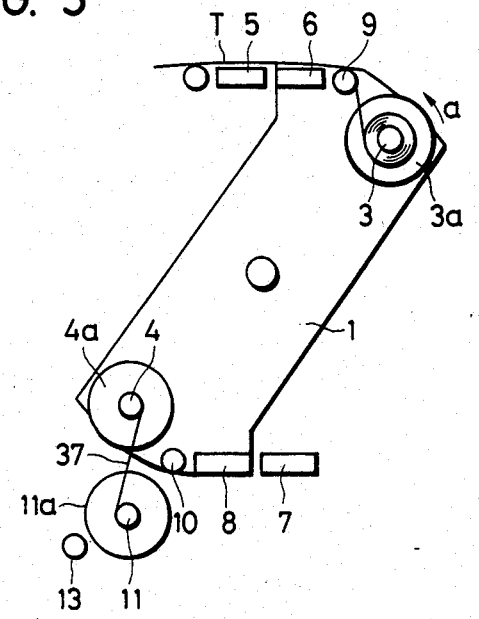
FIGS. 3 through 13 are front views showing essential components in a winding device and an arranging device of the apparatus shown in FIGS. 1 and 2.

In the magnetic tape winding state shown in FIG. 3, a magnetic tape T is being wound in the direction of the arrow a on the reel 3*a*, which has been detachably mounted on the winding shaft 3. In this case, in the arranging unit, a pair of reels on which a leader tape has been wound are mounted on the winding shaft 4 and the shaft 11 by the reel supplying unit, and are lightly retained by a reel retainer (not shown) so that they cannot fall off the shafts but are rotatable.

Figure 4:
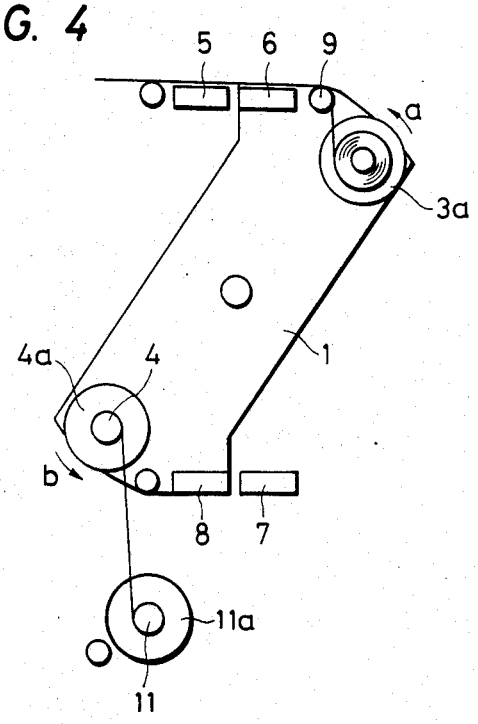

In the winding state shown in FIG. 4, the magnetic tape is further wound on the reel 3*a*, the diameter being increased.

In the arranging unit, the sliding block 12 (FIG. 1), and accordingly the reel 11*a*, is moved along the sliding, shaft 14, that is, it is moved obliquely downwardly in the direction of the arrow D. In this operation, the winding motor 22 (FIG. 2) applies a back tension to the reel 4*a* in the direction of the arrow b (FIG. 4) so that the leader tape is not slackened during the movement of the reel 11*a*.

Figure 5:
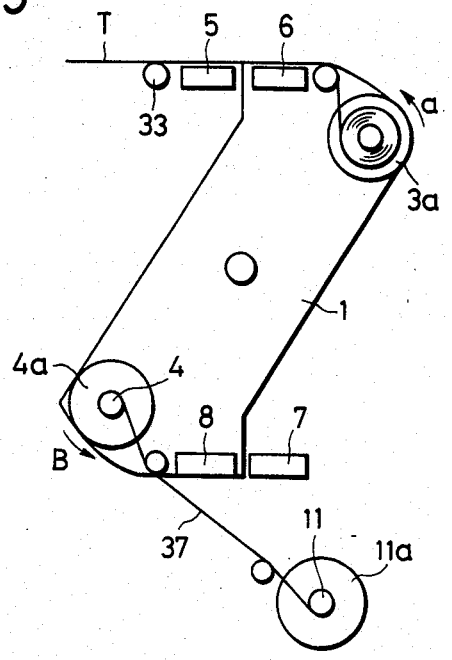

In the winding state illustrated in FIG. 5, the magnetic tape T which is supplied through a series of guide rolls (only one roll 33 being shown) from a magnetic tape supplying source or a magnetic tape roll stock (not shown) is being wound on the reel 3*a*. In this case, in the arranging unit, the swinging block 15 shown in FIG. 1 or 2 is swung about the swinging shaft 16 in the direction of the arrow C (to the right in FIG. 1) by the rotary actuator, and accordingly the reel 11*a* is swung in the same direction while rewinding the leader tape 37.

Figure 6:
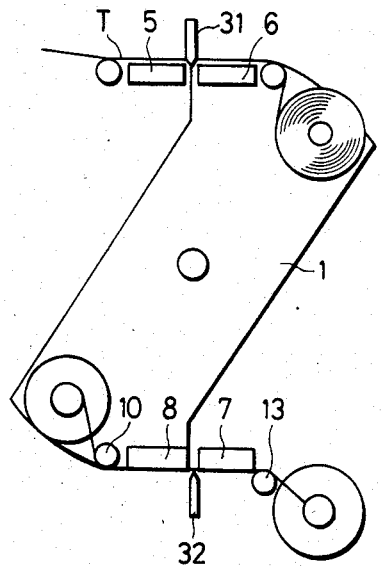

In FIG. 6, in the winding unit, winding the magnetic tape having a predetermined length on the reel is accomplished. The magnetic tape T is retained by suction on the stationary tape receiving stand 5 and the movable tape receiving stand 6, and is then cut with a cutter 31.

On the other hand, in the arranging unit, under the condition shown in FIG. 5, the sliding block 12 is moved obliquely upwardly along the sliding shaft 14 to move the reel 11*a* upwardly. As a result, the leader tape 37 is laid on the stationary tape receiving stand 7 and the movable tape receiving stand 8 with the aid of the guide rollers 10 and 13. The leader tape thus positioned is retained by suction on the stands 7 and 8 and is then cut with a cutter 32.

Figure 7:
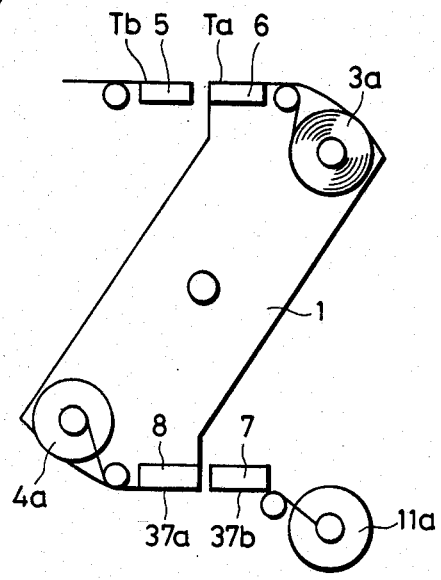

FIG. 7 shows the magnetic tape and the leader tape which have been cut in the winding unit and in the arranging unit.

Figure 8:
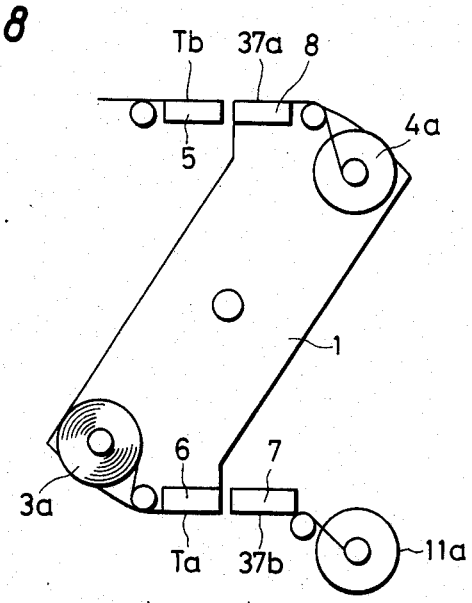

FIG. 8 shows the turntable 1 after it has been turned through 180° from its position shown in FIG. 7.

In the winding unit, the reel 4*a* to which the leader tape has been connected is positioned with the cut end portion 37*a* of the leader tape retained by suction on the movable tape receiving stand 8. At the same time, in the arranging unit, the reel 3*a*' on which the magnetic tape having the predetermined length has been wound is positioned with the cut end portion Ta of the magnetic tape retained by suction on the movable tape receiving stand 6.

Figure 9:
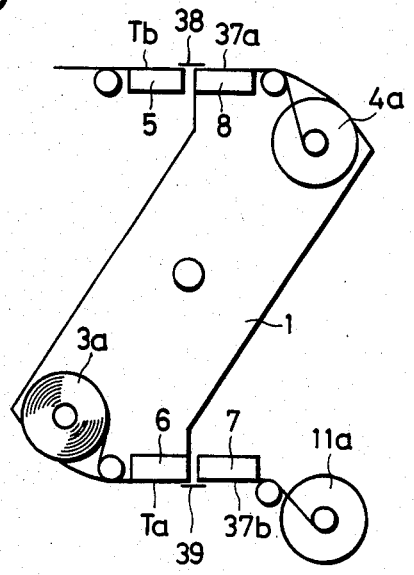

In FIG. 9, in the winding unit, the cut end portion of the leader tape of the reel 4*a*, which is retained on the movable tape receiving stand 8 as described above, is connected to the cut end portion $T_B$ of the magnetic tape supplied from the magnetic tape supplying source, which is retained by suction on the stationary tape receiving stand, using splicing tape 38 supplied from the splicing tape supplying unit (not shown).

On the other hand, in the arranging unit, the cut end portion $T_a$ of the magnetic tape, which has been retained by suction on the movable tape receiving table 6, and the cut end portion 37*b* of the leader tape, which has been retained by suction on the stationary tape receiving stand 7, are joined together with splicing tape 39 supplied from the splicing tape supplying unit (not shown). That is, the reel 3*a* on which the magnetic tape has been wound is connected through splicing tape segments to the reel 11*a* to which the leader tape has been fastened. Thus, the manufacture of one roll of magnetic tape has been completed.

Figure 10:
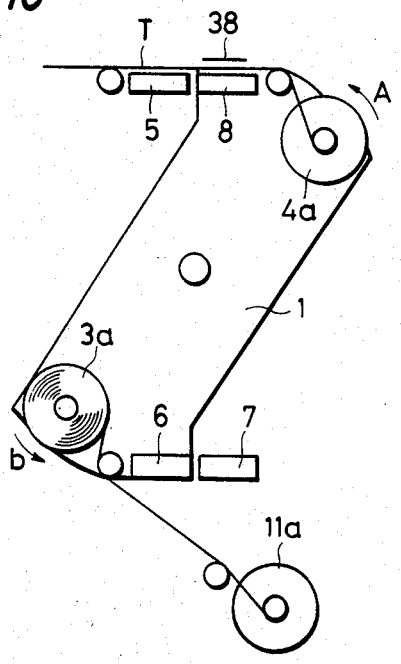

Then, as illustrated in FIG. 10, in the winding unit, the vacuum pressure of the movable tape receiving stand 8 and the stationary tape receiving stand 5 is suspended so that the cut end portions $T_b$ and 37*a* are released from the stands 5 and 8, respectively. Thus, winding of the tape T connected to the leader tape onto the reel 4*a* is started.

In the arranging unit, the vacuum pressure of the stationary tape receiving stand 7 and the movable tape receiving stand 6 is suspended so that the spliced cut end portions are released from the stand 6 and 7. Thereupon, the sliding block 12 is moved obliquely downwardly along the sliding shaft 14; that is, the reel 11*a* is moved in the same direction. In this operation, since the winding motor 22 is energized so as to rotate in the direction of the arrow b, the reel 3*a* winds or rewinds the magnetic tape while maintaining the latter under a predetermined tension to absorb the slack of the magnetic tape which occurs during the movement of the reel 11*a*.

Figure 11:
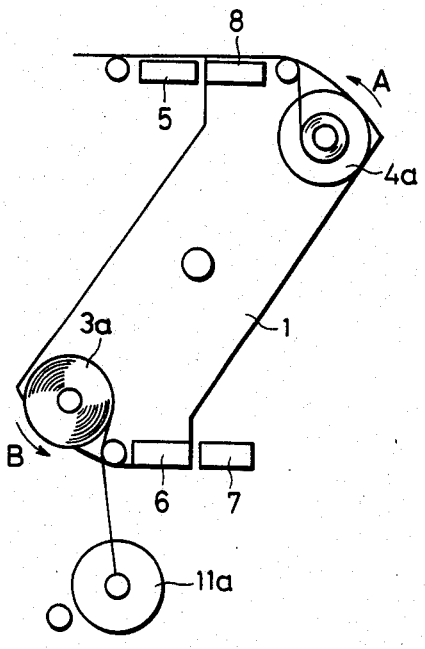
Figure 12:
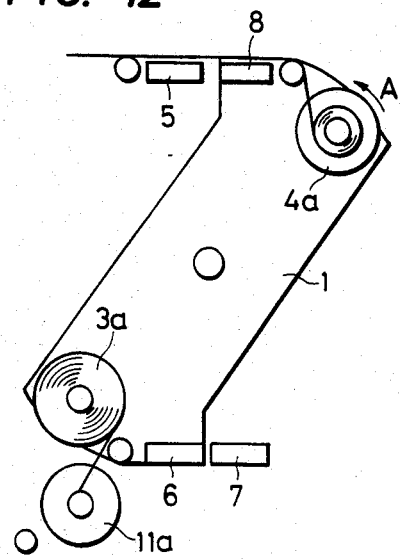

FIGS. 11 and 12 show the magnetic tape as it is gradually wound on the reel 4*a*, increasing its diameter. In this case, in the arranging unit, in the step shown in FIG. 11, the sliding block 12 is set below while the swinging block 15 is swung counterclockwise (to the left in FIG. 1); and in the step of FIG. 12, the sliding block 12 is moved upwardly to the left so that the reel 11*a* approaches the reel 3*a* on the winding shaft 3. The tapes (the magnetic tape and the leader tapes) are wound on the reel 3*a* by the motor 22 in such a manner that they are held under tension to take up any slack.

Figure 13:
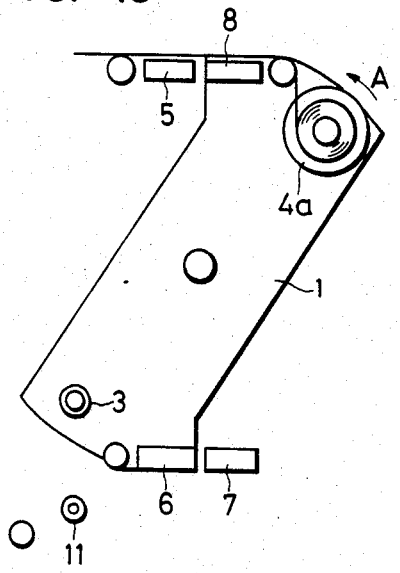

In the step of FIG. 13, one pair or reels 3*a* and 11*a* which have been set close to each other with the tapes wound thereon is removed by the reel supplying unit (not shown) and placed onto a tray for conveyance to a subsequent station.

Through the steps of FIGS. 3 through 13, one cycle of magnetic tape winding operations is accomplished. The next cycle is started from the step of FIG. 3.

While a preferred embodiment of the invention has been described, it will be evident to those skilled in the art that various changes and modifications can be made therein without departing from the invention. For instance, the swinging table and the swinging block may be driven by an oscillating cam instead of the rotary actuator.

In the magnetic tape winding apparatus composed of the winding unit and the arranging unit constructed as described above, the steps of winding the magnetic tape onto a pair of reels are divided into two groups. The two groups of magnetic tape winding steps are carried out in a parallel mode so that the total time required for winding the magnetic tape onto a pair or reels is limited to the sum of (1) the time which is required for connecting one cut end of the leader tape fastened to one reel to the cut end of the magnetic tape from the magnetic tape supplying source, (2) the time required for winding the magnetic tape onto the reel, (3) the time required for the step of cutting the magnetic tape after winding a predetermined length of the magnetic tape onto the reel, and (4) the short time required for turning the turntable. Therefore, in the magnetic tape winding device of the invention, unlike the conventional construction, the standby time is eliminated. Magnetic tape with the leader tapes at both ends can be automatically wound on each of a large number of pairs of reels in a short period of time, for instance about 30 seconds per pair of reels.

When the reel 11*a* is moved away from (or towards) the reel 4*a* (or the reel 3*a*), the reel 11*a* is moved in a plane which is defined by the reel 11*a* and the reel 4*a* (or 3*a*). In addition, the winding shaft 4 (or 3) of the reel 4*a* (or 3*a*) is driven by the motor 22 so that the tape (the magnetic tape or the leader tape) is held under a weak tension. Accordingly, the tapes (the magnetic tape and leader tapes) are handled stably, with the result that the apparatus has an overall high reliability and the magnetic tape products manufactured thereby are excellent in quality.

I claim:

1. A magnetic tape winding apparatus which comprises:

a turntable;

first and second winding shafts and first and second movable tape receiving stands mounted on said turntable, said first winding shaft and said first movable tape receiving stand being arranged symmetrically on opposite ends of said turntable with respect to said second winding shaft and said second movable tape receiving stand, said turntable being rotatably mounted so that positions of said first and second winding shafts and said first and second movable tape receiving stands can be exchanged by turning said turntable through 180°; reel moving means having a reel mounting shaft, and means for moving said reel mounting shaft along a predetermined path, a stationary tape receiving stand being located adjacent one of said first and second movable tape receiving stands as determined by a rotary position of said turntable said reel moving means and said one of said first and second movable tape receiving stands and its associated one of said first and second winding shafts constituting an arranging means;

a second stationary tape receiving stand located adjacent the other of said first and second winding shafts and movable tape receiving stands, each tape receiving stand having means for holding a tape on a surface thereof, said second stationary tape receiving stand and said other of said first and second winding shafts and movable tape receiving stands constituting magnetic tape winding means; and tape cutting means and tape joining means provided for each of said arranging means and said magnetic tape winding means.

2. The magnetic tape winding apparatus of claim 1, wherein said means for moving said reel mounting shaft along a predetermined path comprises: a swinging block pivotally mounted at one end thereof; a shaft extending from the opposite end of said swinging block; and a sliding block slidably mounted on said shaft, said reel mounting shaft of said reel moving means being mounted on said sliding block.

3. The magnetic tape winding apparatus of claim 1, wherein said means for holding said tape comprises a suction plate.

4. The magnetic tape winding apparatus of claim 1, further comprising first and second motors for rotating said first and second winding shafts; and first and second clutches for coupling said first and second motors to adjacent ones of said first and second winding shafts.

5. The magnetic tape winding apparatus of claim 4, wherein each of said first and second clutches comprises: friction plates coupled to respective ones of said first and second winding shafts, and coil means fixed to a rotary shaft of respective ones of said first and second motors, each of said coil means, when activated by passing a current therethrough, attracting adjacent friction plate so as to couple the shaft of said respective one of said first and second motors to the respective one of said first and second winding shafts.

6. The magnetic tape winding apparatus of claim 1, further comprising means for moving said turntable in a direction perpendicular to a plane of said turntable.

7. The magnetic tape winding apparatus of claim 1, further comprising reel supplying means disposed adjacent said magnetic tape winding means for supplying reels to said other of said first and second winding shafts and said reel mounting shaft, said reel supplying means comprising a swinging lever pivoted at one end thereof.

8. A method for operating magnetic tape winding apparatus which comprises:

a turntable; first and second winding shafts and first and second movable tape receiving stands mounted on said turntable, said first winding shaft and said first movable tape receiving stand being arranged symmetrically on opposite ends of said turntable with respect to said second winding shaft and said second movable tape receiving stand, said turntable being rotatably mounted so that positions of said first and second winding shafts and said first and second movable tape receiving stands can be exchanged for each other by turning said turntable through 180°; reel moving means having a reel mounting shaft, and means for moving said reel mounting shaft along a predetermined path, a first stationary tape receiving stand being located adjacent one of said first and second movable tape receiving stands as determined by a rotary position of said turntable; said reel moving means, said first stationary tape receiving stand, and said one of said first and second movable tape receiving stands and its associated one of said first and second winding shafts constituting an arranging means; a second stationary tape receiving stand located adjacent the other of said first and second winding shafts and movable tape receiving stands, each tape receiving stand having means for holding a tape on a surface thereof, said second stationary tape receiving stand and said other of said first and second winding shafts and movable tape receiving stands constituting magnetic tape winding means; and tape cutting means and tape joining means provided for each of said arranging means and said magnetic tape winding means, said method comprising the steps of:

in said arranging means, mounting a pair of reels to which a leader tape has been fastened on said winding shaft and said reel mounting shaft of said arranging means, moving the reel on the side of said reel moving means to a tape cutting and joining section formed by said movable tape receiving stand and said stationary tape receiving stand, holding said leader tape on said movable and stationary tape receiving stands and cutting said tape, rotating said turntable to deliver the reel on the side of said turntable to said magnetic tape winding means with the cut leader tape held on said movable tape receiving stand, and, at said tape cutting and joining section, connecting the magnetic tape wound on the reel which is delivered thereto when said turntable is rotated to the leader tape of the reel remaining at said reel moving means, and in said magnetic tape winding means, connecting the leader tape of the reel delivered from said arranging means to an end of a magnetic tape supplied from a magnetic tape supplying source at a tape cutting and joining section formed by said movable tape receiving stand and the stationary tape receiving stand of said winding means, winding a predetermined length of said magnetic tape on said reel, cutting said magnetic tape at said tape cutting and joining section, and delivering the reel on which the magnetic tape has been wound to said arranging means.

9. The method of claim 8, wherein operations in said arranging means and operations in said magnetic tape winding means are carried out simultaneously.

* * * * *